US008210856B2

(12) United States Patent
Suzuki et al.

(10) Patent No.: US 8,210,856 B2
(45) Date of Patent: Jul. 3, 2012

(54) BOARD TERMINAL

(75) Inventors: Koji Suzuki, Yokkaichi (JP); Yuuji Saka, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 12/913,940

(22) Filed: Oct. 28, 2010

(65) Prior Publication Data

US 2011/0201237 A1 Aug. 18, 2011

(30) Foreign Application Priority Data

Feb. 15, 2010 (JP) ..... 2010-030687

(51) Int. Cl.
*H01R 12/00* (2006.01)

(52) U.S. Cl. ..... 439/78; 439/733.1

(58) Field of Classification Search ..... 439/78, 439/84, 733.1
See application file for complete search history.

(56) References Cited

U.S. PATENT DOCUMENTS 5,263,880 A * 11/1993 Schwarz et al. ..... 439/733.1
5,921,788 A * 7/1999 Wilson et al. ..... 439/78
6,328,576 B1 12/2001 Takahashi
6,811,449 B2 * 11/2004 Yamashita ..... 439/733.1
7,367,819 B2 5/2008 Saka
7,857,637 B2 12/2010 Kasai
2002/0002007 A1 1/2002 Endo et al.

FOREIGN PATENT DOCUMENTS

JP 2000-243495 9/2000
JP 2005-340068 A 12/2005
JP 2009-016328 A 1/2009

OTHER PUBLICATIONS

U.S. Appl. No. 12/843,346 to Hideki Goto, filed Jul. 26, 2010.
U.S. Appl. No. 12/913,882 to Hideki Goto, filed Oct. 28, 2010.

* cited by examiner

*Primary Examiner* — Khiem Nguyen
(74) *Attorney, Agent, or Firm* — Greenblum & Bernstein P.L.C.

(57) ABSTRACT

A board terminal is formed by cutting a metal wire material at a predetermined length, the metal wire material having a cross-sectional shape similar to and slightly larger than a terminal holding hole. A press-fit portion press-fitted to the terminal holding hole is pressure-forged in a direction orthogonal to an axis. Thereby, a tapered portion and a stepped edge portions are provided on both sides of the pressure-forging direction, the tapered portion tapering toward a press-fit direction, the stepped edge portion being provided to an end side of the tapered portion. Further, externally projected portions are provided to both sides of the press-fit portion in the direction orthogonal to the axis which is orthogonal to the pressure-forging direction.

8 Claims, 7 Drawing Sheets

BOARD TERMINAL

CROSS-REFERENCE TO RELATED APPLICATIONS

The present application claims priority under 35 U.S.C. §119 of Japanese Application No. 2010-030687, filed on Feb. 15, 2010, which is herein expressly incorporated by reference in its entirety.

BACKGROUND OF THE INVENTION

1. Field of the Invention

The present invention relates to a board terminal used for connecting an external electric circuit to a printed board circuit housed in an electric junction box and the like for a vehicle. Particularly, the present invention relates to a board terminal fanned of a metal wire material, press-fitted to and held by a synthetic resin terminal holding fixture.

2. Description of Related Art

In order to connect an electrical component to a printed board circuit housed in an electric junction box and the like for a vehicle, a connection terminal formed of a conductive metal material is conventionally used. As disclosed in Japanese Patent Laid-open Publication No. 2000-243495 in particular, the connection terminal is press-fitted to and held in a terminal holding hole penetrating a synthetic resin terminal holding fixture, such as a terminal base, a connector housing, and the like. A first end side of a board terminal is then soldered to a conductive path of a printed board circuit, and a second end side is fitted and connected to a connection terminal and the like of a connector provided to an external wire terminal. Thus, an external electric circuit is connected to a printed board circuit.

In order to achieve a secure and stable connection between the board terminal and the external connection terminal, each board terminal press-fitted to the terminal holding hole of the terminal holding fixture needs to be solidly fixed to a position of the terminal holding fixture and held thereto. A structure is thus proposed, as shown in FIG. 4 of Japanese Patent Laid-open Publication No. 2000-243495, in which first projections and second projections are provided, the first projections projecting both sides in a board width direction of the board terminal, the second projections projecting both sides in a board thickness direction; and projected end surfaces of the respective projections and both opposing surfaces of the terminal holding hole are press-contacted, and fixed by interference fit. Thereby, displacement in both directions of the board thickness and board width of the board terminal can be prevented, and thus the board terminal is solidly fixed to the position, and held thereto.

When the projections are provided in the board width direction and the board thickness direction of the board terminal, and thus a projection amount (overlap margin of the projections and the respective opposing surfaces of the terminal holding hole) is increased so as to increase a holding force of the board terminal, however, a press-fit force of the board terminal to the terminal holding hole is increased. As a result, cost is increased due to increase in size of equipment required for press-fitting, and work efficiency is deteriorated due to decrease in a press-fitting rate.

With recent demand for downsizing and high density of electric junction boxes, board terminals have been increasingly employed which are obtained by cutting a metal wire material at a predetermined length, the metal wire material allowing production of terminals having a small cross section at a high yield. Board terminals having a small cross section formed of the metal wire material tend to cause problems associated with increased press-fit force, such as deformation, buckling, and the like.

SUMMARY OF THE INVENTION

In view of the above, the present invention provides a board terminal having a new structure that allows press-fitting with a small force into a terminal holding hole penetrating a terminal holding fixture, and fixing to a position with a large holding force (disengagement resistance force) after being press-fitted into the terminal holding hole.

A first aspect of the present invention provides a board terminal press-fitted and assembled to a terminal holding hole of a synthetic resin terminal holding fixture. The board terminal is formed by cutting a metal wire material at a predetermined length, the metal wire material having a cross-sectional shape slightly larger than the terminal holding hole. A press-fit portion press-fitted to the terminal holding hole is pressure-forged in a direction orthogonal to an axis. A tapered portion and a stepped edge portion are provided on both sides of the pressure-forging direction, the tapered portion tapering toward a press-fit direction, the stepped edge portion being provided to an end portion of the tapered portion. Externally projected portions are provided to both sides in the direction orthogonal to the axis which is orthogonal to the pressure-forging direction.

According to the first aspect, the board terminal has the cross-sectional shape slightly larger than the terminal holding hole. Thus, when the terminal is press-fitted to the terminal holding hole, the press-fit portion of the terminal is press-contacted to an internal peripheral surface of the terminal holding hole along substantially an entire periphery of an external peripheral surface of the press-fit portion. Thereby, a larger friction resistance force can be generated between the external peripheral surface of the press-fit portion and the internal peripheral surface of the terminal holding hole. Unlike a conventional product, a projection having a high projection height does not need to be provided to the press-fit portion, since a pull-out resistance force (axial positioning force) of the press-fit portion from the terminal holding hole can effectively be ensured in a sufficient amount, based on the large friction resistance force generated between the external peripheral surface of the press-fit portion and the internal peripheral surface of the terminal holding hole. Further, the press-fit portion is provided with the projected portions externally projecting in the direction orthogonal to the axis. Accordingly, an engagement effect of the projected portions to the internal peripheral surface of the terminal holding hole is exerted, thus further increasing the pull-out resistance force of the terminal.

Further, the press-fit portion is provided with the tapered portion, and thus provided with the stepped edge portion to an end side thereof. The stepped edge portion is not hooked to the internal peripheral surface of the terminal holding hole when the terminal is press-fitted to the terminal holding hole. When the press-fit portion is pulled out of the terminal holding hole, however, the press-fit portion exerts a returning function, and then is hooked to the internal peripheral surface of the terminal holding hole, and engaged therewith. The pull-out resistance force of the terminal is thus further effectively increased.

Furthermore, the pull-out resistance force based on the friction resistance force is exerted as described above in the first aspect, and thus the projected portions provided to the press-fit portion do not need to have a high projection height. The press-fit portion can thus be press-fitted to the terminal holding hole with a relatively small force, despite the projected portions provided to the press-fit portion. Further, the tapered portion provided to the press-fit portion has a shape tapering toward the press-fit direction, thus improving insertability of the press-fit portion to the terminal holding hole.

In addition, the press-fit portion has a greater dimension in the direction orthogonal to the axis in a portion to which the projected portions are provided. Further, a portion to which the tapered portion is provided in the press-fit portion is provided with a concave portion having an external surface of the tapered portion as a bottom surface. Thus, when the press-fit portion is press-fitted to the terminal holding hole, a portion of the internal peripheral surface of the terminal holding hole which is contacted with the projected portions is spread out by the projected portions. Concurrently, the internal peripheral surface portion facing the tapered portion bulges internally, due to escape of the resin forming the internal peripheral surface, and thus protrudes into the concave portion having the external surface of the tapered portion as the bottom surface. Then, a stress and a reaction force are advantageously alleviated, the stress being caused in the terminal holding fixture by press-fitting of the press-fit portion to the terminal holding hole, the reaction force being urged against a pressure force of the press-fit portion. Consequently, a press-fit resistance force of the press-fit portion to the terminal holding hole is reduced to some extent, thus improving insertability of the press-fit portion to the terminal holding hole. The internal peripheral surface portion of the terminal holding hole bulging internally and protruding into the concave portion due to press-fitting of the press-fit portion is engaged with the above-described stepped edge portion. The engagement effect can further advantageously increase the pull-out resistance force.

A second aspect of the present invention provides the board terminal according to the first aspect, in which the metal wire material is a rectangular wire material having a rectangular cross section. A first pair of opposing side portions thereof are provided with the tapered portion and the stepped edge portion. A second pair of opposing side portions are provided with the projected portions.

According to the present aspect, a portion of the stepped edge portion positioned in a corner portion in a circumferential direction of the press-fit portion has an angular shape in both axial and circumferential directions, and is formed in a shaper shape. Thus, the engagement effect of the stepped edge portion to the internal peripheral surface of the terminal holding hole, and the pull-out resistance force (axial positioning force) based thereon can further be enhanced.

A third aspect of the present invention provides the board terminal according to the first or second aspect, in which a contact projection is provided closer to a rear end side in the press-fit direction than the tapered portion, the contact projection projecting to an external periphery, and contacting an opening portion on a rear end side of the terminal holding hole of the terminal holding fixture, and thereby determining a press-fit end position to the terminal holding hole.

According to the present aspect, the press-fit end position of the board terminal is easily and surely determined. Further, when the contact projection of the board terminal is contacted, a resistance force is exerted against a pressure force urged by a terminal of a mating connector to be connected with the board terminal. Thus, the board terminal can securely be held in a predetermined position when the board terminal is connected to the terminal of the mating connector. Thereby, connection with the terminal of the mating connector can be performed easily and smoothly.

A fourth aspect of the present invention provides the board terminal according to one of the first to third aspects, in which an axial length of the tapered portion and the projected portions is shorter than an axial length of the terminal holding hole.

According to the present aspect, the stepped edge portion is surely positioned in the terminal holding hole, when the press-fit portion is press-fitted to the terminal holding hole. Thus, the engagement effect of the stepped edge portion to the internal peripheral surface of the terminal holding hole can surely be exerted, and thus improvement in the pull-out resistance forced (axial positioning force) based thereon can surely be achieved. In addition to the projected portions and the tapered portion, terminal portions provided to a front end side and a rear end side in the press-fit direction of aforementioned portions are press-fitted to the terminal holding hole, the terminal portions having a cross-sectional shape slightly larger than the terminal holding hole. The terminal portions are then press-contacted to the internal peripheral surface of the terminal holding hole along the entire periphery of the external peripheral surface. Thereby, the pull-out resistance force of the terminal as a whole can further effectively be enhanced.

According to the present invention, the board terminal can be press-fitted to the terminal holding hole of the terminal holding fixture with a small force, and thus cost reduction and improvement in work efficiency of press-fitting can advantageously be achieved. In addition, when the press-fit portion is press-fitted to the terminal holding hole, the board terminal can be fixed to the position with a large holding force, due to a sufficiently large pull-out resistance force.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 4 illustrates an example of a manufacturing process of the board terminal shown in

FIG. 1;

DETAILED DESCRIPTION OF PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The embodiments of the present invention are explained below with reference to the drawings.

Figure 1:
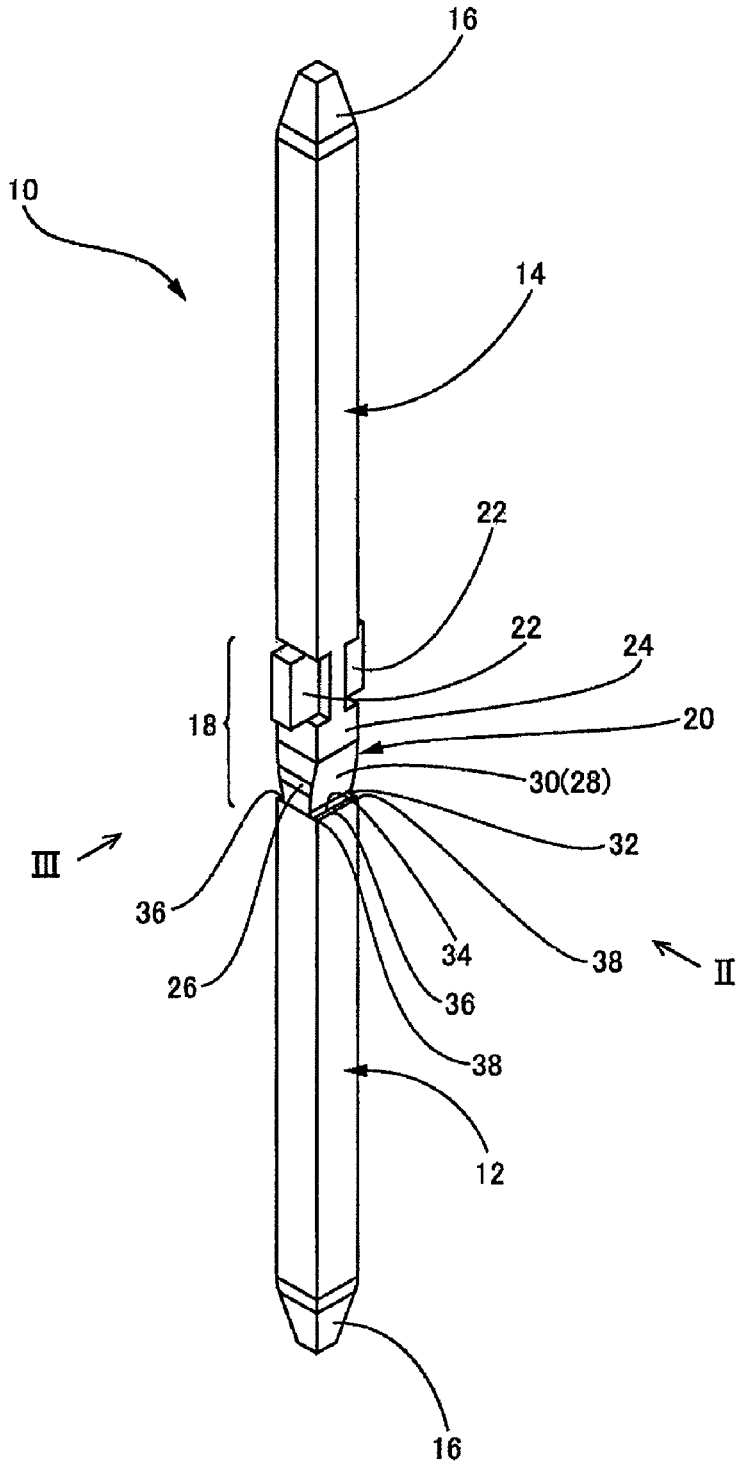
FIG. 1 is a perspective view illustrating an embodiment of a board terminal having a structure according to the present invention.

As an embodiment of a board terminal having a structure according to the present invention, FIG. 1 first illustrates, from a perspective view, a terminal for a printed board housed in an electric junction box for a vehicle. As shown in FIG. 1, a board terminal 10 of the present embodiment may have any suitable shape, such as an elongated quadrangular prism shape as a whole. The board terminal 10 has a shape similar to a terminal holding hole 56 provided to a terminal holding base 48 as a synthetic resin terminal holding fixture hereinafter described. The board terminal 10 is formed of a cut off wire material provided by cutting a metal rectangular wire material at a predetermined length, the metal rectangular wire material having a slightly large rectangular shape press-fittable to the terminal holding hole 56 from a cross-sectional view orthogonal to an axis. The board terminal 10 is press-fitted to the terminal holding hole 56, and thus assembled to the terminal holding base 48 and held thereby (refer to FIGS. 5 to 7).

Figure 6:
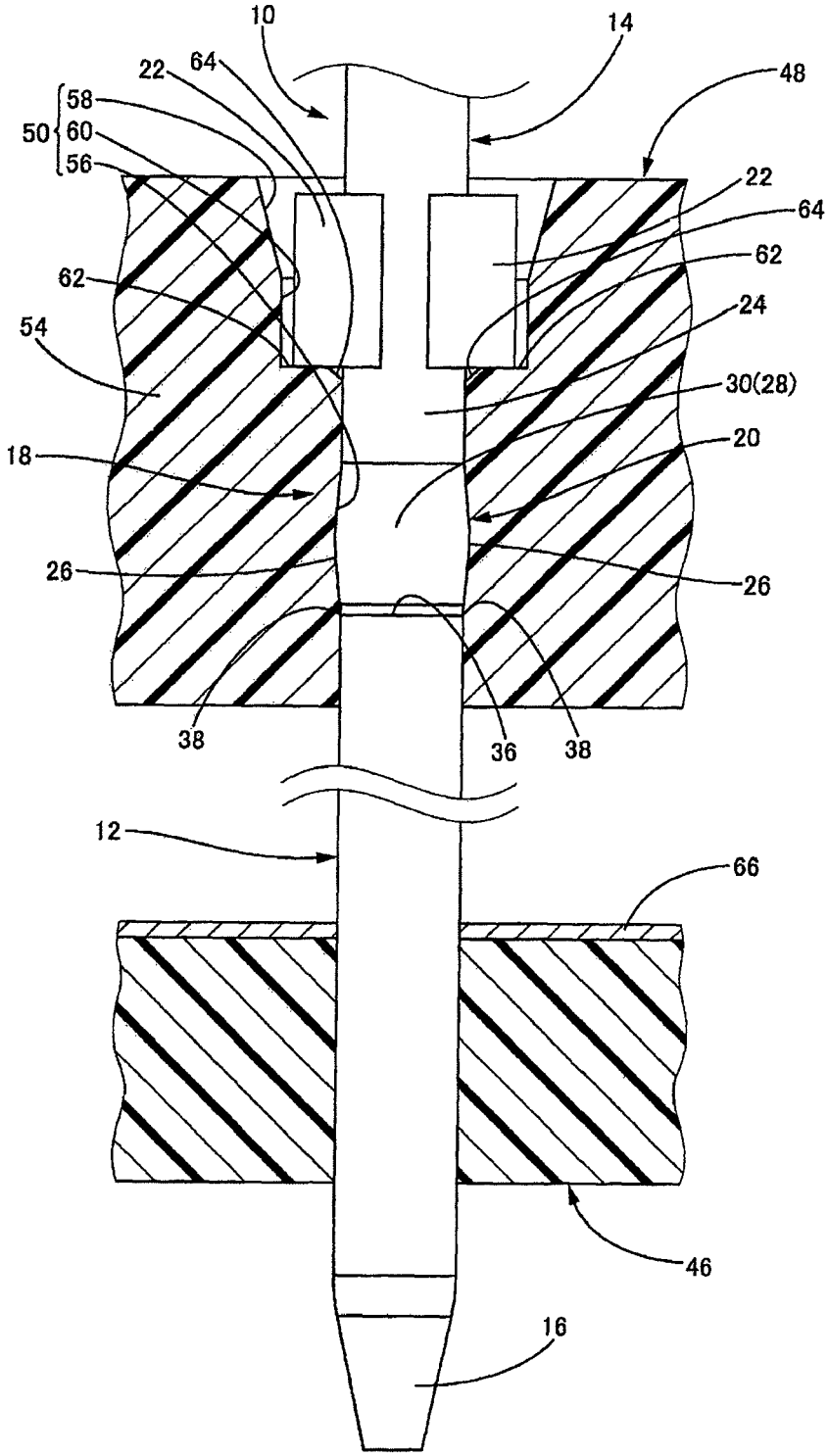
FIG. 6 is a partially enlarged view of the board terminal shown in FIG. 5, along VI-VI.
Figure 7:
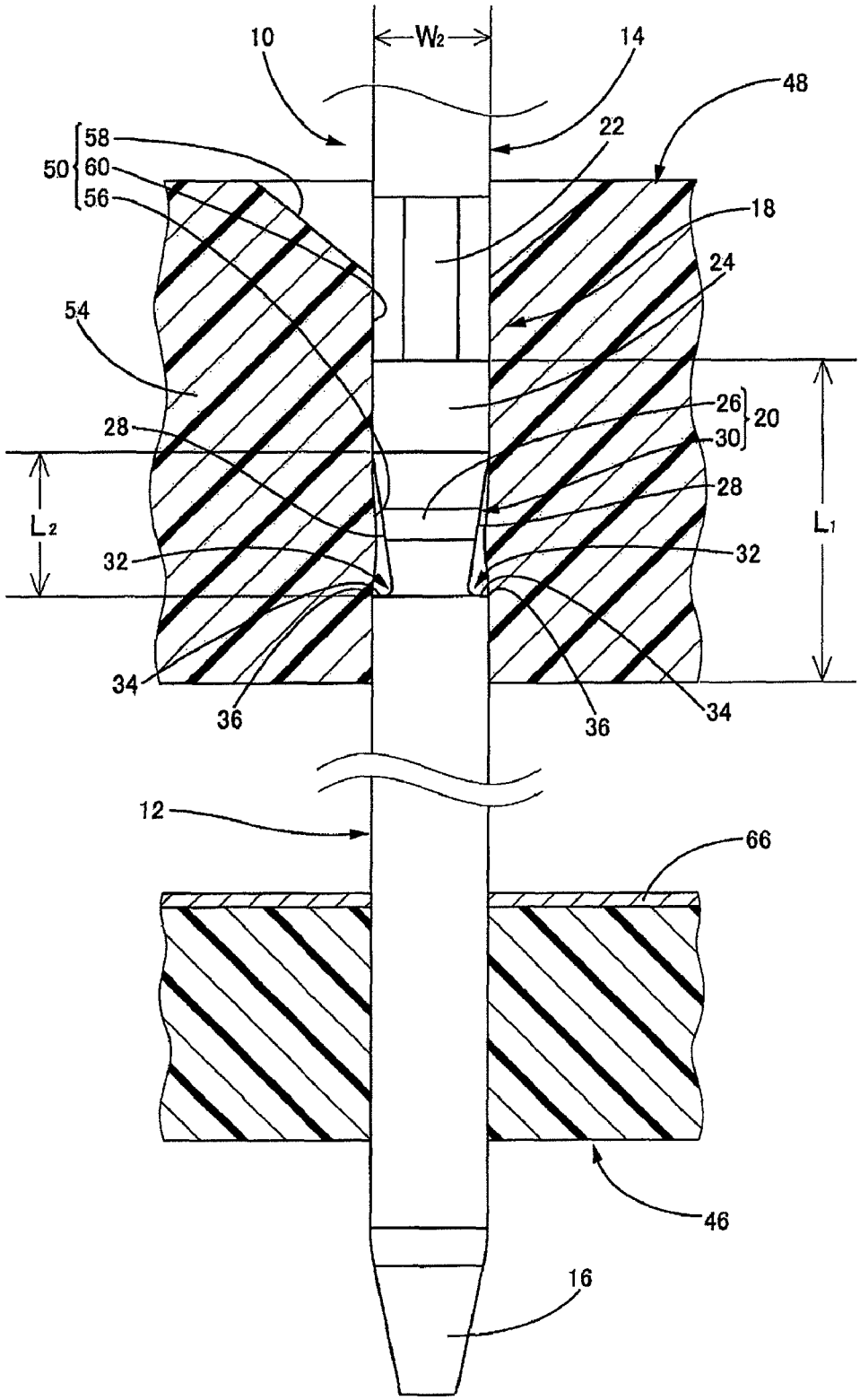
FIG. 7 is a partially enlarged view of the board terminal shown in FIG. 5, along VII-VII.

Specifically, the board terminal 10 is provided with a board connection portion 12 on a first end side in an axial direction (length direction), which is a front end portion in a press-fit direction to the terminal holding hole 56. The board terminal 10 is further provided with a connector connection portion 14 on a second end side, which is a rear end portion in the press-fit direction to the terminal holding hole 56. In a state in which the board terminal 10 is held by the terminal holding base 48, the board connection portion 12 is soldered and fixed to a conductive path 66 provided to a printed board 46, and thus having an electrically connected portion (FIGS. 6 and 7). In a state in which the board terminal 10 is held by the terminal holding base 48, the connector connection portion 14 has an electrically connected portion with an electric contact portion of a mating connector (not shown in the drawing). In the explanation below, the board connection portion 12 side of the board terminal 10 is referred to as a front end side of a press-fit direction, and the connector connection portion 14 side of the board terminal 10 is referred to as a rear end side of the press-fit direction.

Tapered portions 16 may have any suitable shape, such as a quadrangular pyramid trapezoidal shape tapering toward an end, are provided respectively to an end portion of the board connection portion 12 (front end side of the press-fit direction) and an end portion of the connector connection portion 14 (rear end side of the press-fit direction). Thus, the board terminal 10 can more smoothly be inserted to the terminal holding hole 56 of the terminal holding base 48, as described hereinafter. The tapered portions 16 are easily formed in any suitable manner, such as by forging to compress the end portions of the board connection portion 12 and the connector connection portion 14.

The board connection portion 12 and the connector connection portion 14 are not processed at all in portions on an intermediate side of the board terminal 10, excluding the tapered portions 16. Thus, the portions of the board connection portion 12 and the connector connection portion 14 excluding the tapered portions 16 have a cross-sectional shape orthogonal to the axis similar to the terminal holding hole 56 and a slightly large rectangular cross-sectional shape press-fittable to the terminal holding hole 56.

An axially intermediate portion of the board terminal 10 between the board connection portion 12 and the connector connection portion 14 is an assembly portion 18. The assembly portion 18 has a press-fit portion 20, and two contact projections 22 integrally provided to portions away from the press-fit portion 20 (tapered portion 30) at a predetermined distance to the rear end side of the press-fit direction.

Figure 2:
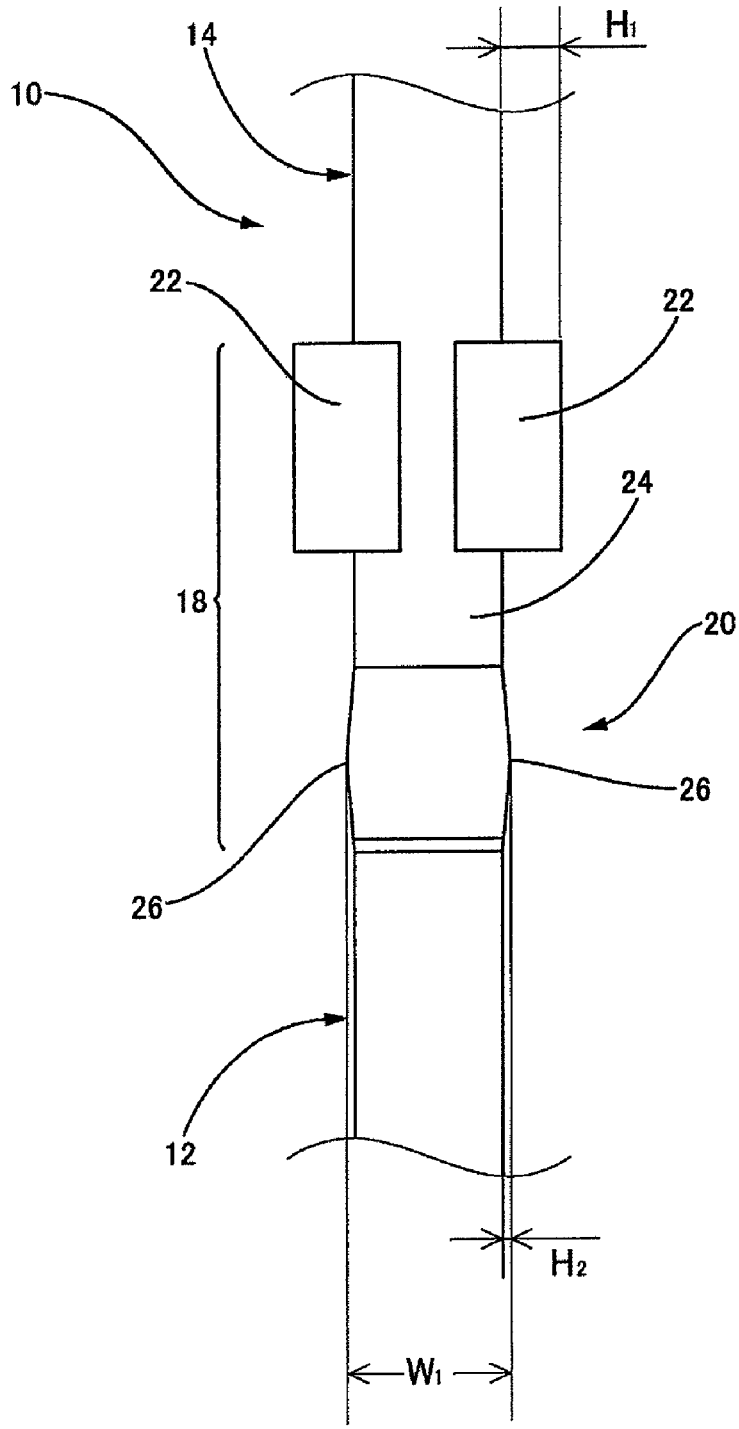
FIG. 2 is an partially enlarged view of the board terminal shown in FIG. 1, from a fragmentary view of II.
Figure 3:
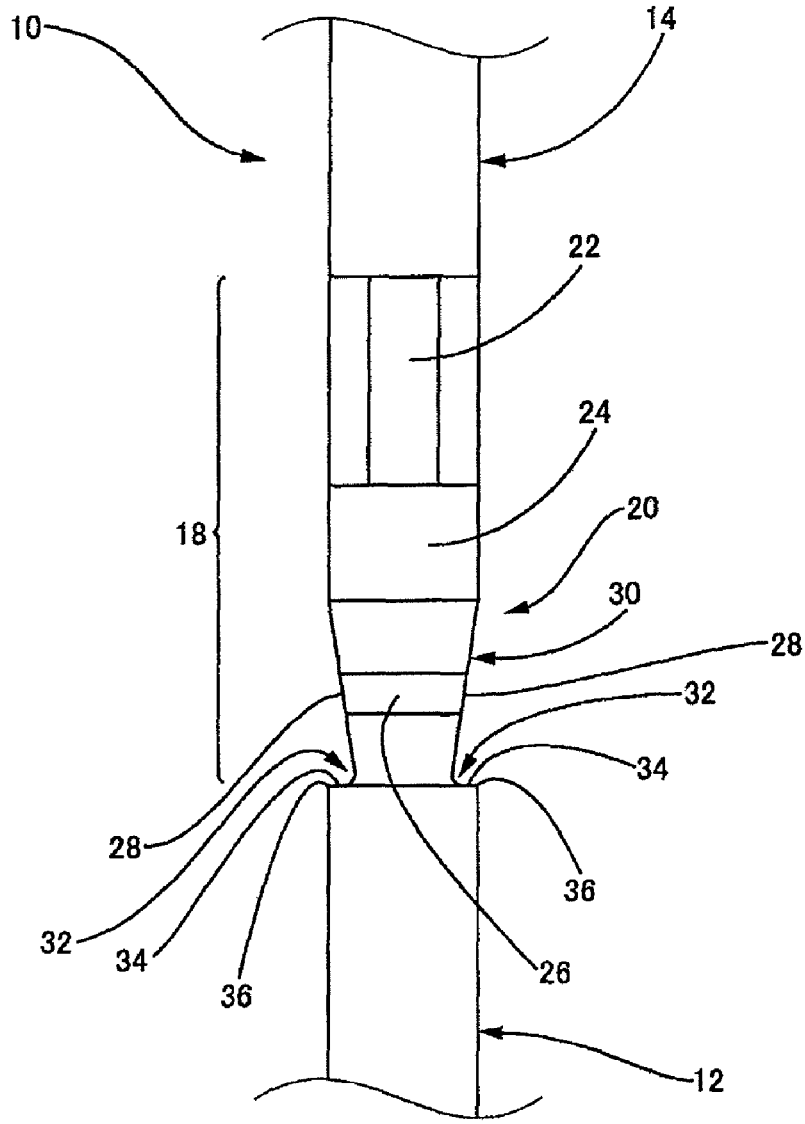
FIG. 3 is an partially enlarged view of the board terminal shown in FIG. 1, from a fragmentary view of III.

As shown in FIGS. 2 and 3, each of the two contact projections 22 has a thickness thinner than the board terminal 10 (vertical direction on the plane of FIG. 2), and has any suitable shape, such as an elongated rectangular planar shape extending in the axial direction of the board terminal 10. The two contact projections 22 project from side surfaces at a predetermined height H1, the side surfaces being positioned on both sides in a width direction (horizontal direction of FIG. 2) of the board terminal 10. A middle portion in a width direction of the portion to which the two contact projections 22 are provided in the assembly portion 18, has a thickness same as the connector connection portion 14.

In the assembly portion 18, the two contact projections 22 are provided to a position closer to the rear end side of the press-fit direction than the press-fit portion 20 by a predetermined distance. Thereby, an intermediate portion 24, which is provided to a position between the portion to which the two contact projections 22 are provided and a portion to which the press-fit portion 20 is provided in the assembly portion 18, has a cross-sectional shape orthogonal to the axis same as a cross-sectional shape of the metal wire material. Specifically, the intermediate portion 24 has a cross-sectional shape substantially same as the terminal holding hole 56 and a slightly large rectangular cross-sectional shape.

As shown in FIG. 2, meanwhile, two projected portions 26 are integrally provided to the press-fit portion 20, such that the two projected portions 26 project in a same direction as the two contact projections 22. The two projected portions 26 are formed by an entirety of two side surfaces bulging externally at a predetermined height H2, the two side surfaces being positioned on both sides in the width direction of the press-fit portion 20 (same side surfaces as surfaces to which the two contact projections 22 are provided in the assembly portion 18). The height H2 is sufficiently lower than the height H1.

Specifically, the portion on the rear end side of the press-fit direction (upper side of FIG. 2) on side surfaces on both sides in the width direction of the press-fit portion 20 is a projecting curved surface or an inclined surface bulging or inclining, respectively, externally in the width direction (externally orthogonal to the axis) toward the front end side of the press-fit direction. Further, the portion on the front end side of the press-fit direction (lower side of FIG. 2) on the side surfaces on both sides in the width direction of the press-fit portion 20 is a projecting curved surface or an inclined surface bulging or inclining, respectively, externally in the width direction toward the rear end side of the press-fit direction. Furthermore, the intermediate portion of the press-fit direction on the side surfaces on both sides in the width direction of the press-fit portion 20 is a flat surface having a predetermined width and spreading in the press-fit direction. Thus, an axial cross section parallel to the width direction of the press-fit portion 20 has substantially a barrel shape. The projected portions 26 are provided respectively to the two side surfaces on both sides in the width direction of the press-fit portion 20 (pair of opposing side portions of the board terminal 10 formed of rectangular wire material), the both sides providing the two curved portions having a cross-sectionally barrel shape and externally bulging in the width direction.

The projection height H2 of the projected portions 26 is sufficiently lower than a projection height of a projection for engagement provided to a conventional board terminal (for example, a first engagement projection 14 and a second engagement projection 16 shown in FIG. 1 of Japanese Patent Laid-open Publication No. 2000-243495). In the present embodiment, a maximum width of the press-fit portion 20 integrally provided with the projected portions 26 (dimension indicated with W1 in FIG. 2) as above is thus greater by 0.8 mm than a width of the terminal holding hole 56 (dimension indicated with W2 in FIG. 7) of 1.49 mm. The maximum width W1 of the press-fit portion 20 and the width W2 of the terminal holding hole 56 are by no means limited to the dimensions above, and any suitable dimensions can be provided.

As shown in FIG. 3, two side surfaces circumferentially adjacent to the two side surfaces on both sides in the width direction constituting the projected portions 26 in the press-fit portion 20, specifically two side surfaces located on both sides in the thickness direction of the press-fit portion 20, are provided as inclined surface portions 28 respectively inclining internally in the thickness direction (internally in the orthogonal direction to the axis) toward the front end side of the press-fit direction. In other words, the two inclined surface portions 28 formed by the side surfaces on both sides in the thickness direction of the press-fit portion 20 incline in a direction closer to each other toward the front end side of the press-fit direction. An axial cross section parallel to the thickness direction of the press-fit portion 20 has a trapezoidal shape having a gradually narrowing width toward the front end side of the press-fit direction.

Thereby, the tapered portion 30 tapering toward the front end side of the press-fit direction of the press-fit portion 20 is formed by the two inclined surface portions 28, which are two side surfaces provided on both sides in the thickness direction of the press-fit portion 20 (a pair of opposing side portions different from the pair of opposing side portions constituting the projected portions 26 of the board terminal 10 formed of the rectangular wire material). Further, concave portions 32 are provided on both sides in the thickness direction of the press-fit portion 20, the concave portions 32 having the inclined surface portions 28 as bottom surfaces. Specifically, the inclined surface portions 28 are provided, such that the concave portions 32 are provided on the both sides in the thickness direction of the press-fit portion 20.

As described above, the press-fit portion 20 has a trapezoidal shape whose axial cross section parallel to the width direction thereof gradually narrows toward the front end side of the press-fit direction. As shown in FIGS. 1 and 3, a stepped surface 34 widening in the direction orthogonal to the axis is thus provided to each of both sides in the thickness direction of the press-fit portion 20, in a boundary portion between the press-fit portion 20 and the board connection portion 12 positioned closer to the front end side of the press-fit direction than the press-fit portion 20. The stepped surfaces 34 also constitute side surfaces of the concaved portions 32. Corner portions having substantially a right angle provided between the stepped surfaces 34 and an external peripheral surface of the board connection portion 12 are provided as stepped edge portions 36.

In other words, the stepped edge portions 36 are provided to the boundary portion between the press-fit portion 20 and the board connection portion 12 respectively on both sides in the thickness direction of the board terminal 10 (pair of opposing side portions to which the two inclined surface portions 28 are provided, the inclined surface portions 28 providing the tapered portions 30 of the board terminal 10 formed of the rectangular wire material). Further, each of the stepped edge portions 36 has two sharp angular edge portions 38, each of which is formed by the corner portion and the stepped surface 34, the corner portion being provided between side surfaces adjacent in the circumferential direction of the board connection portion 12.

The board terminal 10 having the structure above may be produced in any suitable manner, such as the following, for example.

A metal rectangular wire material is first prepared, the metal rectangular wire material having a same shape as the terminal holding hole 56, and having a slightly large rectangular shape press-fittable to the terminal holding hole 56 from a cross-sectional view orthogonal to the axis. Then, the metal rectangular wire material is cut at a predetermined length, and thereby a cut off wire 40 is provided.

Figure 4:
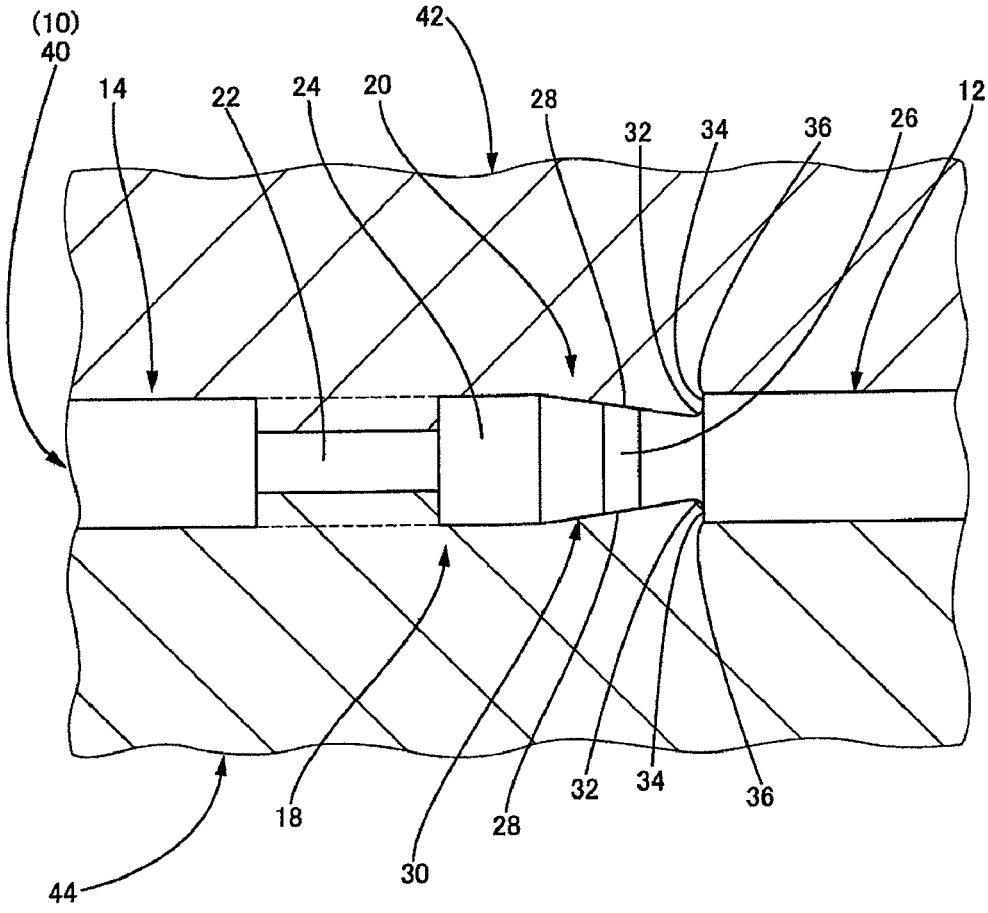

Thereafter, the cut off wire 40 is press-formed using a punch 42 and a die 44, as shown in FIG. 4. The punch 42 and the die 44 used herein are provided with recesses and projections corresponding to an external surface shape of the assembly portion 18 of the board terminal 10. The punch 42 and the die 44 then exert a forging pressure (pressing pressure) on the cut off wire 40 placed in between in a thickness direction thereof.

In the press-forming using the punch 42 and the die 44, the portion of the assembly portion 18 on the connector connection portion 14 side and the press-fit portion 20 are stamped in the thickness direction. The portion of the assembly portion 18 on the connector connection portion 14 side is thereby provided with the two contact projections 22 projecting in the width direction, or the direction orthogonal to the axis, which is orthogonal to the forging pressure direction in the press-forming. Concurrently, the press-fit portion 20 of the assembly portion 18 is provided on both sides of the forging pressure direction, with the tapered portion 30 tapering toward the front end side of the press-fit direction; and the stepped edge portions 36 are provided on the end side of the tapered portion 30. Further, the projected portions 26 are formed bulging in the direction orthogonal to the axis which is orthogonal to the forging pressure direction. Thereby, the board terminal 10 having the structure shown in FIGS. 1 to 3 is provided.

Figure 5:
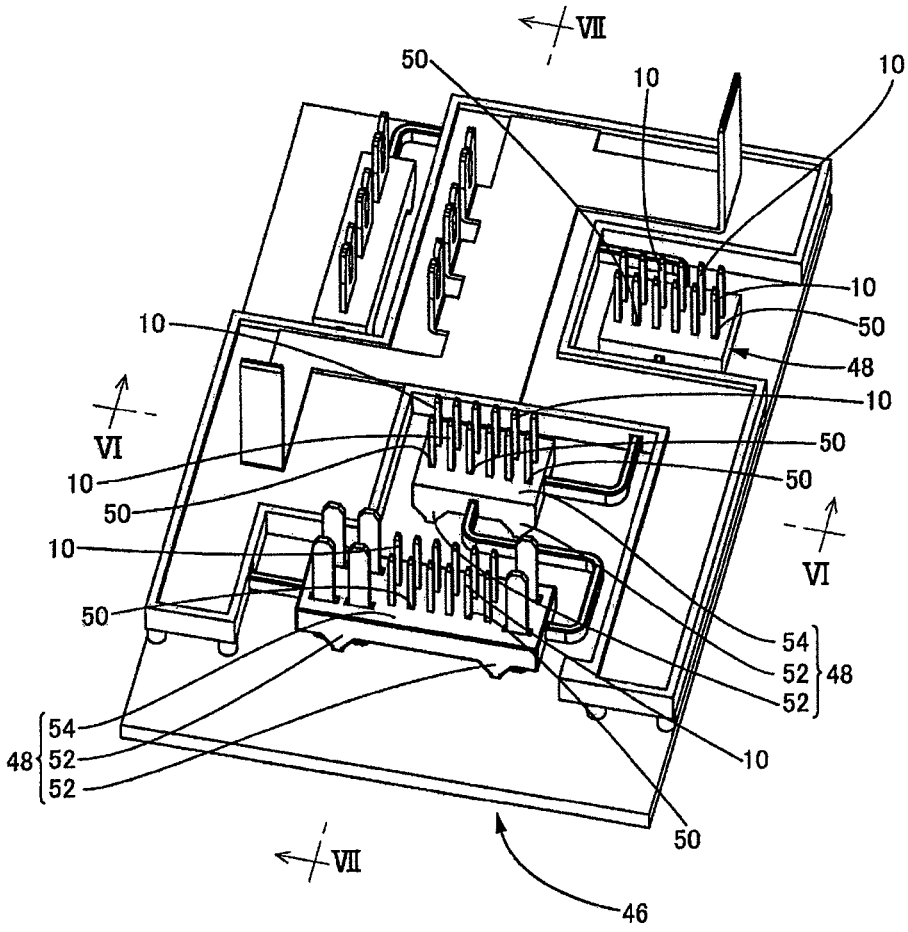
FIG. 5 is a perspective view illustrating a state in which the board terminal shown in FIG. 1 is assembled to a board.

The board terminal 10 as above is passed through and assembled to the terminal holding base 48 mounted on the printed board 46, and then held thereby, as shown in FIG. 5. The board terminal 10 is further mounted to the printed board 46 in the state in which the board terminal 10 is held.

More specifically, the terminal holding base 48 has a pair of leg portions 52 standing on the printed board 46, and a top plate portion 54 provided over the pair of leg portions 52. A plurality of through-holes 50 penetrating the top plate portion 54 of the terminal holding base 48 are provided through the length and width.

As shown in FIGS. 6 and 7, each of the through-holes 50 is provided with the terminal holding hole 56, which is a lower opening side portion formed of substantially a lower half portion positioned on a front end side (lower side in FIGS. 6 and 7, and printed board 46 side) in an insertion direction (press-fit direction to the terminal holding hole 56) of the board terminal 10. The terminal holding hole 56 has a constant sized cross-sectional shape orthogonal to the axis (cross-sectional shape orthogonal to an extending direction), and extends straight in a thickness direction of the top plate portion 54. The constant sized cross-sectional shape orthogonal to the axis is a same shape as the cross-sectional shape orthogonal to the axis of the board connection portion 12 and the connector connection portion 14 of the board terminal 10, and is a slightly small rectangular shape to which the board connection portion 12 and the connector connection portion 14 are press-fittable. The terminal holding hole 56 has an extension length (dimension indicated with L1 in FIG. 7)

longer by a predetermined length than the axial length (dimension indicated with L2 in FIG. 7) of the press-fit portion 20 of the board terminal 10.

Further, the through-hole 50 is provided with a guide hole 58, which is an upper opening side portion formed of a portion on a rear end side of the insertion direction (upper side in FIGS. 6 and 7) of the board terminal 10. The guide hole 58 has a rectangular hopper shape from a cross-sectional view orthogonal to the axis, the hopper shape gradually widening upward. Specifically, an upper portion of four internal surfaces of the through-hole 50 has an inclined surface shape inclined upward toward outside.

The through-hole 50 is provided with two housing recesses 60 in an intermediate portion between the terminal holding hole 56 (lower opening portion) and the guide hole 58 (upper opening portion). The two housing recesses 60 are provided respectively to two internal surfaces opposing in the width direction of the board terminal 10, in a state in which the board terminal 10 is inserted to the through-hole 50. The housing recesses 60 have any suitable shape, such as a rectangular shape larger than the contact projections 22 integrally provided to the side surfaces on the both sides in the width direction of the assembly portion 18 of the board terminal 10. Of the internal surfaces of the housing recesses 60, the internal surfaces spreading in the direction orthogonal to the axis of the through-hole 50 are provided as engagement surfaces 62 contacting and engaging with the contact projections 22.

In an intermediate portion of the through-hole 50, inclined guide surfaces 64 are provided between the engagement surfaces 62 of the housing recesses 60 and the internal surfaces of the terminal holding hole 56, the inclined guide surfaces 64 being surfaces inclined upwardly toward outside. Further, two internal surfaces opposing in the thickness direction of the board terminal 10 in the intermediate portion of the through-hole 50, have a distance in between slightly smaller than the thickness of the board connection portion 12 and the connector connection portion 14 of the board terminal 10.

As being guided by the internal surfaces of the guide hole 58 and the inclined guide surfaces 64, the board terminal 10 is smoothly inserted through (inserted into) the through-hole 50 having the structure above, from the tapered portion 16 side in the end portion of the board connection portion 12.

The board connection portion 12 of the board terminal 10 inserted though the through-hole 50 is projected downward from the lower opening portion of the terminal holding hole 56. The tapered portion 16 of the board connection portion 12 is passed through the printed board 46. The axial intermediate portion of the board connection portion 12 is soldered to the conductive path 66 provided on the printed board 46 (not shown in the drawing) and fixed thereto, and thus electrically connected.

Further, the two contact projections 22 in the assembly portion 18 of the board terminal 10 inserted through the through-hole 50 are housed into the two housing recesses 60 provided to the axial intermediate portion of the through-hole 50. Then, lower surfaces (surfaces on the board connection portion 12 side) of the contact portions 22 are engaged with the engagement surfaces 62 of the respective housing recesses 60. An insertion position of the board terminal 10 into the through-hole 50 and a press-fit position of the board terminal 10 into the terminal holding hole 56 are thus determined. Accordingly, the board terminal 10 inserted through the through-hole 50 is displaced from a state in which the contact projections 22 are engaged with the engagement surfaces 62 to the printed board 46 side. The board terminal 10 is thus prevented from changing the press-fit position to the terminal holding hole 56. It is effective in retaining the board terminal 10 to a predetermined position, when the connector connection portion 14 of the board terminal 10 is connected to a mating connector (not shown in the drawing) in assembly of the board terminal 10 to the terminal holding base 48.

When the contact projections 22 are housed in the housing recesses 60 as described above, the press-fit portion 20 in the assembly portion 18 of the board terminal 10 is press-fitted to the terminal holding hole 56. The extension length L1 of the terminal holding hole 56 is provided longer than the axial length L2 of the press-fit portion 20 of the board terminal 10. Thus, when the press-fit portion 20 is press-fitted to the terminal holding hole 56, the intermediate portions 24 of the assembly portion 18 and an end portion on an opposite side to the tapered portion 16 of the board connection portion 12 are press-fitted to the terminal holding hole 56, the intermediate portions 24 being positioned on the axial both sides sandwiching the press-fit portion 20 of the board terminal 10, such that the intermediate portions 24 and the end portion are press-contacted along entire peripheries thereof to an internal peripheral surface of the terminal holding hole 56. Further, both side surfaces in the thickness direction in the portion to which the two contact projections 22 are provided in the assembly portion 18, are press-contacted to the internal peripheral surface in the axial intermediate portion of the through-hole 50. Thereby, a sufficiently large friction resistance force is generated between the axial intermediate portion of the board terminal 10 and the internal peripheral surface of the through-hole 50, along an entire length of the axial intermediate portion of the board terminal 10, the axial intermediate portion including the press-fit portion 20, the internal peripheral surface including the internal peripheral surface of the terminal holding hole 56.

In addition, when the board terminal 10 is press-fitted to the terminal holding hole 56, the two projected portions 26 of the press-fit portion 20 exert a large pressing pressure on the pair of opposing internal surfaces of the terminal holding hole 56. Thereby, a much larger friction resistance force is generated between the projected portions 26 and the internal surface of the terminal holding hole 56, and the projected portions 26 are press-contacted against the internal surface of the terminal holding hole 56 in a state in which the projected portions 26 are engaged with the internal surface of the terminal holding hole 56. The projected portions 26 are provided with flat surfaces in intermediate portions, the flat surface spreading in the press-fit direction of the board terminal 10 to the terminal holding hole 56. Thereby, a large contact area between the projected portions 26 and the internal surface of the terminal holding hole 56 is provided, and thus the friction resistance force generated against the terminal holding hole 56 is further increased.

As described above, when the board terminal 10 is press-fitted to the terminal holding hole 56, a pull-out resistance force (axial positioning force) of the press-fit portion 20 from the terminal holding hole 56 is effectively ensured in a sufficient amount due to mutual effect of the large friction resistance force and the engagement effect. The friction resistance force is generated when the axial intermediate portion including the press-fit portion 20 is press-contacted in a large contact area against the internal peripheral surface of the through-hole 50, including the internal peripheral surface of the terminal holding hole 56. The engagement effect is obtained when the projected portions 26 are engaged with the internal surface of the terminal holding hole 56.

When the press-fit portion 20 is pulled out from the terminal holding hole 56, the stepped edge portions 36 provided to the press-fit portion 20 exert a returning function, and then are hooked to the internal peripheral surface of the terminal holding hole 56, and thus engaged therewith. In addition, each of the stepped edge portions 36 has the two sharp angular edge portions 38, which are further securely engaged with the internal peripheral surface of the terminal holding hole 56. Thereby, the pull-out resistance force of the press-fit portion 20 from the terminal holding hole 56 is further increased.

Although the projected portions 26 engaged with the internal peripheral surface of the terminal holding hole 56 have a relatively low projection height, the press-fit portion 20 of the board terminal 10 has a sufficiently large pull-out resistance force from the terminal holding hole 56. Thus, the board terminal 10 can be held to the terminal holding base 48 with a large holding force.

The board terminal 10 has a cross-sectional shape similar to and slightly larger than that of the terminal holding hole 56. The projected portions 26 provided to the press-fit portion 20 have a relatively low projection height. When the press-fit portion 20 is press-fitted to the terminal holding hole 56, the stepped edge portions 36 are not hooked to the internal peripheral surface of the terminal holding hole 56. Thus, the projected portions 26 and the stepped edge portions 36 do not interfere with insertion operation of the press-fit portion 20 to the terminal holding hole 56. The press-fit portion 20 can then be press-fitted to the terminal holding hole 56 with a small insertion force (press-fit force), compared with a terminal having a conventional structure having a large projection. Further, the tapered portion 30 provided to the press-fit portion 20 has a shape tapering toward the press-fit direction, thus enhancing insertability of the press-fit portion 20 to the terminal holding hole 56.

In addition, when the board terminal 10 is press-fitted to the terminal holding hole 56, the projected portions 26 exert a large pressure force against the press-contacted internal surface of the terminal holding hole 56. Resin forming the terminal holding base 48 is caused to escape at the time, and then the internal surfaces of the terminal holding hole 56 facing the inclined surface portions 28 of the tapered portion 30 bulge out, as being inserted to the concave portions 32 having the inclined surface portions 28 as bottom surfaces (refer to FIG. 7). Thus, a stress caused in the terminal holding base 48 and a reaction force against the pressure force are advantageously alleviated, based on the pressure force exerted by the projected portions 26. Thereby, the press-fit resistance force of the press-fit portion 20 to the terminal holding hole 56 can be reduced to some extent.

Accordingly, the press-fit portion 20 of the board terminal 10 can smoothly be press-fitted to the terminal holding hole 56 with a relatively small press-fit force. Thus, large equipment is not required to insert the board terminal 10 to the terminal holding hole 56, and a press-fit rate is also increased. Thereby, both cost reduction and increase in efficiency can advantageously be achieved in insertion of the board terminal 10 to the terminal holding hole 56. It can further be effectively prevented that the terminal holding base 48 is deformed or damaged due to a large press-fit force at the time of press-fitting of the board terminal 10 to the terminal holding hole 56. Furthermore, bulging of the internal surfaces of the terminal holding hole 56 to the concave portions 32 also largely contributes to improvement of the pull-out resistance force associated with the engagement effect of the stepped edge portion 36 to the internal surfaces of the terminal holding hole 56.

The embodiment of the prevent invention is explained in detail above. The present invention, however, is not limited by specifics in the explanation. For instance, any shape may be employed for the tapered portion 30, as long as the tapered shape can be formed when the cut off wire material 40 is forged by exerting forging force in the direction orthogonal to the axis, the cut of wire material 40 being provided by cutting a metal wire material at a predetermined length. Examples of the shape of the tapered portion 30 may include a circular cross-sectional shape orthogonal to the axis, a projecting curved surface, a recessed curved surface, and a combination of the above listed shapes.

The metal wire material used as the forming material of the board terminal 10 may be changed appropriately. In the above-described embodiment, the metal wire material has a rectangular cross-sectional shape orthogonal to the axis similar to that of the terminal holding hole 56. As long as a metal wire material has an angular cross-sectional shape orthogonal to the axis slightly larger than that of the terminal holding hole, however, any metal wire material having a cross-sectional shape similar to or different from that of the terminal holding hole may be employed.

The present invention can advantageously be applied to a board terminal other than a terminal for a printed board housed in an electric junction box for a vehicle, as shown as an example.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A board terminal configured to be press-fitted and assembled to a terminal holding hole of a synthetic resin terminal holding fixture, the board terminal comprising:

a predetermined length of metal wire material having a cross-sectional shape slightly larger than the terminal holding hole;

a press-fit portion configured to be press-fitted to the terminal holding hole, the press-fit portion being pressure-forged in a direction orthogonal to an axis of the metal wire material;

tapered portions and stepped edge portions provided on side surfaces of the press-fit portion, the tapered portions tapering toward a press-fit direction and the stepped edge portions being provided at end portions of the tapered portions; and externally projected portions provided on sides of the press-fit portion in the direction orthogonal to the axis which is orthogonal to the pressure-forging direction, wherein the externally projected portions are provided on side surfaces of the press-fit portion which are different from the side surfaces of the press-fit portion that provide the tapered portions.

2. The board terminal according to claim 1, wherein the metal wire material is a rectangular wire material having a rectangular cross section; a first pair of opposing side portions thereof being provided with the tapered portions and the stepped edge portions; and a second pair of opposing side portions being provided with the projected portions.

3. The board terminal according to claim 1, wherein contact projections are provided closer to a rear end side in the press-fit direction than the tapered portions, the contact projections projecting to an external periphery, and being configured to contact an opening portion on a rear end side of the terminal holding hole of the terminal holding fixture, and thereby determining a press-fit end position to the terminal holding hole.

4. The board terminal according to claim 2, wherein contact projections are provided closer to a rear end side in the press-fit direction than the tapered portions, the contact projections projecting to an external periphery, and being configured to contact an opening portion on a rear end side of the terminal holding hole of the terminal holding fixture, and thereby determining a press-fit end position to the terminal holding hole.

5. The board terminal according to claim 1, wherein an axial length of the tapered portions and the projected portions is shorter than an axial length of the terminal holding hole.

6. The board terminal according to claim 2, wherein an axial length of the tapered portions and the projected portions is shorter than an axial length of the terminal holding hole.

7. The board terminal according to claim 3, wherein an axial length of the tapered portions and the projected portions is shorter than an axial length of the terminal holding hole.

8. The board terminal according to claim 4, wherein an axial length of the tapered portions and the projected portions is shorter than an axial length of the terminal holding hole.

* * * * *